US007275317B2

(12) United States Patent
Kamata et al.

(10) Patent No.: US 7,275,317 B2
(45) Date of Patent: Oct. 2, 2007

(54) METHOD OF PRODUCTION FOR A WIRING HARNESS JOB ORDER

(75) Inventors: Takeshi Kamata, Shizuoka (JP); Makoto Katsumata, Shizuoka (JP); Hitoshi Ushijima, Shizuoka (JP); Shigeharu Suzuki, Shizuoka (JP); Keigo Sugimura, Shizuoka (JP); Kiyoshi Yagi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 196 days.

(21) Appl. No.: 10/495,744

(22) PCT Filed: Oct. 30, 2002

(86) PCT No.: PCT/JP02/11264

§ 371 (c)(1),
(2), (4) Date: Nov. 17, 2004

(87) PCT Pub. No.: WO03/046933

PCT Pub. Date: Jun. 5, 2003

(65) Prior Publication Data

US 2005/0060881 A1 Mar. 24, 2005

(30) Foreign Application Priority Data

Nov. 27, 2001 (JP) ..... 2001-361002

(51) Int. Cl.
*H01R 43/00* (2006.01)
*H01R 11/00* (2006.01)

(52) U.S. Cl. ..... 29/857; 29/825; 29/747; 29/854; 29/868; 439/502

(58) Field of Classification Search ..... 29/857, 29/868, 876, 701, 825, 747, 854; 439/502, 439/504, 505; 700/101, 99; 219/56; 43/20
See application file for complete search history.

(56) References Cited

U.S. PATENT DOCUMENTS 4,114,014 A * 9/1978 Shogo et al. ..... 219/56

(Continued)

FOREIGN PATENT DOCUMENTS

| | | |
|---|---|---|
| DE | 12 99 336 B | 7/1969 |
| DE | 32 19 569 A1 | 12/1983 |
| FR | 2 555 397 A | 5/1985 |
| GB | 2 282 339 A | 5/1995 |
| JP | 7-1645 | 1/1995 |
| JP | 2001-6460 | 1/2001 |

OTHER PUBLICATIONS

Notification of the First Office Action (PCT Application in the National Phase), along with Text Portion of the First Office Action No. 02826464.9, from the Chinese Patent Office dated Apr. 7, 2006.

*Primary Examiner*—A. Dexter Tugbang
*Assistant Examiner*—Tai Van Nguyen
(74) *Attorney, Agent, or Firm*—Kratz, Quintos & Hanson, LLP

(57) ABSTRACT

An object of the present invention is to provide a wiring harness job-order production method and a wiring harness job-order production system, wherein a space for producing a wiring harness is reduced and the production efficiency of the wiring harness is improved. The wiring harness job-order production system 1 has a wiring harness assembling portion 15, an electric wire stock portion 13, and a parts stock portion 14. The wiring harness assembling portion 15 outputs wire amount data DT1 to the electric wire stock portion 13 when the wiring harness assembling portion 15 receives an order from a wiring harness ordering side 38. The wiring harness assembling portion 15 outputs parts amount data DT2 to the parts stock portion 14 when the wiring harness assembling portion 15 receives an order from the wiring harness ordering side 38. The electric wire stock portion 13 conveys a non-colored electric wire toward the wiring harness assembling portion 15. The parts stock portion 14 conveys non-colored parts toward the wiring harness assembling portion 15.

4 Claims, 10 Drawing Sheets

U.S. PATENT DOCUMENTS 4,424,627 A * 1/1984 Tarbox ..... 29/857
5,329,690 A * 7/1994 Tsuji et al. ..... 29/701
5,443,389 A * 8/1995 Hughes ..... 439/35
5,470,253 A * 11/1995 Siems et al. ..... 439/491
5,477,463 A * 12/1995 Tamura ..... 700/117
5,862,774 A * 1/1999 Moss ..... 116/200
6,596,942 B2 * 7/2003 Ito et al. ..... 174/72 A

* cited by examiner

METHOD OF PRODUCTION FOR A WIRING HARNESS JOB ORDER

TECHNICAL FIELD

The present invention relates to a wiring harness job-order production method and a wiring harness job-order production system for producing a wiring harness to be arranged on a motor vehicle as a moving body.

BACKGROUND ART

Various kinds of electronic equipment are carried on a motor vehicle. Therefore, a wiring harness is arranged on the motor vehicle so that electric power from a power source and control signals from a computer can be supplied to the electronic equipment. The wiring harness has electric wires, terminal fittings attached to the electric wires, and other parts such as connector housings, tubes, protectors, tapes, grommets and the like.

The electric wire has a conductive core wire and an insulative covering portion covering the core wire. The electric wire is the so-called covered wire. The connector housing is made of insulative synthetic resin in a box-shape. The connector housing accommodates the terminal fittings. The terminal fittings and the connector housing constitute the connector. The tube is made of insulative and elastic synthetic resin in a cylindrical shape or a bellows-shape. The tube protects the electric wire inside thereof.

The protector is made of insulative synthetic resin, having a gutter-like cross-section. The protector accommodates the electric wire, and the tape is wound around the protector. The tape is made of flexible synthetic resin. An adhesive face is formed on one surface of the tape. The tape is wound around the electric wires or the above protector. The grommet is made of insulative and elastic synthetic resin in a cylindrical shape or a bellows-shape. The grommet lets the electric wire pass therethrough and engages a hole of a panel forming a vehicle body, while exhibiting waterproofing and sound insulation property.

With regard to the electric wire of the wiring harness, the thickness of the core wire, material (for example, from viewpoint of heat-resistance) of the covering portion, and service conditions should be distinguished. Here, the service conditions mean systems such as an air-bag system, an antilock brake system, and a power transmission system in which the electric wires are used.

The electric wires of the wiring harness are variously colored in order to distinguish the above service conditions (i.e. systems). In manufacturing the prior art electric wire, the electric wire is colored by mixing a colorant with specified color into the insulative synthetic resin when the core wire is covered with the insulative synthetic resin.

Further, the above parts are colored in various colors in order to distinguish attaching positions thereof. In manufacturing the prior art parts, a colorant with a specified color is mixed into the synthetic resin when the parts are injection-molded in a specified shape.

When the wiring harness is assembled, the electric wire and the parts are to be stocked at Step S101 of FIG. 16. Next, at Step S102, the electric wire is cut into pieces with specified lengthes, the electric wires are connected if necessary, and Step S103 is reached. At Step S103, the electric wires, the terminal fittings, and the above parts such as the connector housing and the grommet are prepared, and Step S104 is reached.

At Step S104, the parts are attached to the electric wire so as to assemble a sub-harness, and Step S105 is reached. That is, the sub-harness consists of the electric wires, the terminal fittings attached to the electric wires, and the above parts. At Step S105, the wiring harness is assembled by using the sub-harnesses, and Step S106 is reached. At Step S106, a conductivity test and an appearance inspection are carried out for the wiring harness. At Step S107, the wiring harness is shipped to a motor vehicle manufacturer or the like.

On the other hand, various demands arise from users for the motor vehicle. That is, the motor vehicle is expected to have various kinds of electronic equipment. Consequently, the wiring harness sometimes consists of not less than 100 kinds of the electric wires and various kinds of parts such as the connector housing and the grommet. A motor vehicle is required to be of low cost and to be assembled in a shortest period of time.

Therefore, a factory to manufacture or assemble the wiring harness has to stock not less than 100 kinds of electric wires and various kinds of parts before receiving the order for the wiring harness from a motor vehicle manufacturer. Therefore, the factory of the wiring harness has to keep a very large space for the electric wires and the parts.

In the wiring harness production method of FIG. 16, a step of once stocking the electric wires is required between Step S101 and Step S102 and between Step S102 and Step S103. The electric wire and the parts are also once stocked between Step S103 and Step S104. Further, the sub-harness is once stocked between Step S104 and Step S105. As described, in the prior art production method, the number of the electric wires and the parts to be stocked once is very large. Since there are many kinds of the electric wires and the parts, the number of the electric wires and the parts to be stocked once further increases.

Therefore, in the prior art wiring harness production method of FIG. 16, the space to once stock the electric wires and the parts are required in a factory of the wiring harness. Therefore, the production efficiency of the wiring harness is not good.

In view of the foregoing, an object of the present invention is to provide a wiring harness job-order production method and a wiring harness job-order production system, wherein a space for producing a wiring harness is reduced and the production efficiency of the wiring harness is improved.

DISCLOSURE OF THE INVENTION

In order to achieve the above object, a wiring harness job-order production method, wherein sub-harness each having electric wires and terminal fittings attached to the electric wires are assembled and a wiring harness is manufactured by putting the sub-harness together, is characterized in that the method comprising the steps of: securing a non-colored electric wire by a required length after a receipt of order for a wiring harness, coloring an outer surface of the electric wire, cutting the electric wire in a specified length, attaching the terminal fittings to the electric wires thereby to obtain the sub-harnesses, and putting the sub-harnesses together.

Accordingly, the non-colored electric wire is secured by a required length after the receipt of order for the wiring harness. Therefore, the amount (the length) of the electric to be stocked beforehand can be reduced. Further, the non-colored electric wire is used. Therefore, the kind (color kind) of the electric wire to be stocked beforehand can be reduced.

The sub-harness is assembled after, for example, coloring the outer surface of the non-colored electric wire, and the sub-harnesses are assembled into the wiring harness. Therefore, the sub-harness or the electric wire only has to be once stocked between the assembly of the sub-harnesses and the assembly of the wiring harness.

The wiring harness job-order production method is characterized in that the sub-harness has parts attached to either the electric wires or the terminal fittings, and required non-colored parts are secured after a receipt of order for the wiring harness, outer surfaces of the non-colored parts are colored, the colored parts are attached to the electric wires or he terminal fittings thereby to assemble the sub-harness.

Accordingly, the non-colored parts are also secured after the receipt of order for the wiring harness. Therefore, the amount of the parts, in addition to the electric wire, to be stocked beforehand can be reduced. Further, the non-colored parts are used. Therefore, the kind (color kind) of the parts, in addition to that of the electric wire, to be stocked beforehand can be reduced.

The sub-harness is assembled after, for example, coloring the outer surfaces of the non-colored electric wire and non-colored parts, and the sub-harnesses are assembled into the wiring harness. Therefore, the sub-harness, the electric wire, or the parts only has to be once stocked between the assembly of the sub-harnesses and the assembly of the wiring harness and the coloring of the parts and the attaching of the parts to the sub-harness.

Here, the "non-colored" state in this specification is a state that synthetic resin forming the covering portion of the electric wire and the parts is not mixed with the colorant or is not painted, and therefore the outer surface of the electric wire or of the parts has the color of the synthetic resin itself.

In this specification, "to color the outer surface of the electric wire and the parts" means to color the outer surface of the covering portion of the electric wire and the outer surfaces of the parts with a colorant. The colorant is a liquid substance in which color material (organic substance for industry) is dissolved and dispersed in water or in other solvent. As the organic substance, there exists dyes and pigments (mostly organic substance and synthetic material). In the present specification, "colorant" means both the paint and the coloring liquid.

In the coloring liquid, the dye is dissolved or dispersed in the solvent. In the paint, the pigment is dispersed in the dispersion liquid. Therefore, when the outer surface of the covering portion and the outer surfaces of the parts are colored by the coloring liquid, the dye soaks into in the covering portion and the parts, and when the outer surface of the covering portion and the outer surfaces of the parts are colored by the paint, the pigment adheres to the outer surfaces without soaking therein. That is, "to color the outer surface of the covering portion of the electric wire and the outer surfaces of the parts" in the present specification means to dye the outer surface of the covering portion of the electric wire and the outer surfaces of the parts with the dye and also to paint the pigment on the outer surface of the covering portion of the electric wire and the outer surfaces of the parts.

The solvent and the dispersion liquid should have an affinity for synthetic resin forming the covering portion of the electric wire and the outer surfaces of the parts so that the dye securely soaks into the covering portion of the electric wire and the outer surfaces of the parts and the pigment securely adheres to the outer surface of the covering portion of the electric wire and the outer surfaces of the parts.

In this specification, the parts includes, for example, the connector housing made of insulative synthetic resin in a box-shape, the tube made of insulative and elastic synthetic resin in a cylindrical shape or a bellows-shape, the protector made of insulative synthetic resin and having a gutter-like cross-section, the grommet made of insulative and elastic synthetic resin in a cylindrical shape or a bellows-shape, and the tape made of flexible synthetic resin and having an adhesive face formed on one surface thereof, which are attached to the electric wires or the terminal fittings, while constitute the wiring harness.

A wiring harness job-order production system, comprising: an electric wire stock portion to stock a non-colored electric wire; and a wiring harness assembling portion having a sub-harness assembling portion to assemble a sub-harness having electric wires and terminal fittings attached to the electric wires and manufacturing a wiring harness by putting together the sub-harnesses assembled at the sub-harness by putting together the sub-harnesses assembled at the sub-harness assembling portion, is characterized in that the wiring harness assembling portion makes wire amount data indicating an amount of the electric wire required for an ordered amount of the wiring harness from an ordering side and sends the wire amount data to the electric wire stock portion, the electric wore stock portion conveys the non-colored electric wire in accordance with the wire amount data toward the wiring harness assembling portion, and the sub-harness assembling portion has a coloring unit to color an outer surface of the non-colored electric wire, colors the outer surface of the non-colored electric wire supplied from the electric wire stock portion by using the coloring unit, cuts the colored electric wire in a specified length, attaches the terminal fitting to the cut wire, and assembles the sub-harness.

Accordingly, the wiring harness assembling portion sends the wire amount data indicating the required amount of the electric wire to the electric wire stock portion after the receipt of order from the ordering side. The electric wire stock portion conveys the non-colored electric wire in accordance with the wire amount data toward the wiring harness assembling portion. Therefore, the amount (the length) of the electric wire to be once stocked at the wiring harness assembling portion can be reduced. Further, the non-colored electric wire is used. Therefore, the kind (color kind) of the electric wire to be stocked beforehand can be reduced.

The sub-harness is assembled by the sub-harness assembling portion after, for example, coloring the outer surface of the non-colored electric wire by the coloring unit, and the sub-harnesses are assembled into the wiring harness by the wiring harness assembling portion. Therefore, the sub-harness or the electric wire only has to be once stocked after the assembly of the sub-harness by the sub-harness assembling portion.

The wiring harness job-order production system is characterized in that the system has a parts stock portion to stock non-colored parts to be attached to either the electric wires or the terminal fittings, the wiring harness assembling portion makes parts amount data indicating amounts of the parts required for ordered amounts of the wiring harness from an ordering side and send the parts amount data to the parts stock portion, the parts stock portion conveys the non-colored parts in accordance with the parts amount data toward the wiring harness assembling portion, and the wiring harness assembling portion has a second coloring unit to color outer surfaces of the non-colored parts, colors the outer surfaces of the non-colored parts supplied from the parts stock portion by using the second coloring unit, and attaches the colored parts to either the electric wires or the terminal fittings.

Accordingly, the wiring harness assembling portion sends the parts amount data indicating the required amount of the parts, in addition to the wire amount data, to the parts stock portion after the receipt of order from the ordering side. The parts stock portion conveys the non-colored parts in accordance with the parts amount data toward the wiring harness assembling portion. Therefore, the amount of the parts, in addition to the amount of the electric wire, to be once stocked at the wiring harness assembling portion can be reduced. Further, the non-colored parts are used. Therefore, the kind (color kind) of the parts to be stocked beforehand can be reduced.

The sub-harness is assembled by the sub-harness assembling portion after, for example, coloring the outer surfaces of the non-colored parts by the second coloring unit, and the sub-harnesses are assembled into the wiring harness by the wiring harness assembling portion. Therefore, the sub-harness, the electric wire, or the parts only has to be once stocked after the assembly of the sub-harness by the sub-harness assembling portion.

A wiring harness job-order production method, wherein sub-harnesses each having electric wires and terminal fittings attached to the electric wires are assembled and a wiring harness is manufactured by putting the sub-harnesses together, is characterized in that the method comprises the steps of: securing a non-colored electric wire by a required length after a receipt of order for a wiring harness, coloring an outer surface of non-colored electric wire, further coloring the outer surface, cutting the electric wire in a specified length, attaching the terminal fittings to the electric wires thereby to obtain the sub-harnesses, and putting the sub-harnesses together.

Accordingly, the non-colored electric wire is secured by a required length after the receipt of order for the wiring harness. Therefore, the amount (the length) of the electric to be stocked beforehand can be reduced. Further, the outer surface of the non-colored electric wire is colored after the receipt of order for the wiring harness. Therefore, the kind (color kind) of the electric wire to be stocked beforehand can be reduced.

The sub-harness is assembled after, for example, further coloring the outer surface of the non-colored electric wire, and the sub-harnesses are assembled into the wiring harness. Therefore, the sub-harness or the electric wire only has to be once stocked between the assembly of the sub-harnesses and the assembly of the wiring harness.

The wiring harness job-order production method is characterized in that the sub-harness has parts attached to either the electric wires or the terminal fittings, and required non-colored parts are secured after a receipt of order for the wiring harness, outer surfaces of the non-colored parts are colored, the colored parts are attached to the electric wires or the terminal fittings thereby to assemble the sub-harness.

Accordingly, the non-colored parts are further secured after the receipt of order for the wiring harness. Therefore, the amount of the parts, in addition to the electric wire, to be stocked beforehand can be reduced. Further, the parts are colored after the receipt of order for the wiring harness. Therefore, the kind (color kind) of the parts, in addition to that of the electric wire, to be stocked beforehand can be reduced.

A wiring harness job-order production system, comprising: an electric wire stock portion to stock a non-colored electric wire; a coloring portion to color an outer surface of the non-colored electric wire; and a wiring harness assembling portion having a sub-harness assembling portion to assemble a sub-harness having electric wires and terminal fittings attached to the electric wires and manufacturing a wiring harness by putting together the sub-harnesses assembled at the sub-harness assembling portion, is characterized in that the wiring harness assembling portion makes wire amount data indicating an amount of the electric wire required for an ordered amount of the wiring harness from an ordering side and sends the wire amount data to the electric wire stock portion, the electric wire stock portion conveys the non-colored electric wire in accordance with the wire amount data toward the coloring portion, the coloring portion colors the outer surface of the non-colored electric wire toward the wiring harness assembling portion, and the sub-harness assembling portion has a coloring unit to color an outer surface of the non-colored electric wire, further colors the outer surface by using the coloring unit, cuts the colored electric wire in a specified length, attaches the terminal fitting to the cut wire, and assembles the sub-harness.

Accordingly, the wiring harness assembling portion sends the wire amount data indicating the required amount of the electric wire to the electric wire stock portion after the receipt of order from the ordering side. The electric wire stock portion conveys the non-colored electric wire in accordance with the wire amount data toward the coloring portion. The coloring portion colors the non-colored electric wire and conveys the colored electric wire toward the wiring harness assembling portion. Therefore, the amount (the length) of the electric wire to be once stocked at the wiring harness assembling portion can be reduced. Further, the outer surfaces of the non-colored electric wire are colored after the receipt of order for the wiring harness. Therefore, the kind (color kind) of the electric wire to be stocked beforehand can be reduced.

The sub-harness is assembled by the sub-harness assembling portion after, for example, further coloring the outer surface of the electric wire by the coloring unit, and the sub-harnesses are assembled into the wiring harness by the wiring harness assembling portion. Therefore, the sub-harness or the electric wire only has to be once stocked after the assembly of the sub-harness by the sub-harness assembling portion.

The wiring harness job-order production system is characterized in that the system has a parts stock portion to stock non-colored parts to be attached to either the electric wires or the terminal fittings, the wiring harness assembling portion makes parts amount data indicating amounts of the parts required for ordered amounts of the wiring harness from an ordering side and send the parts amount data to the parts stock portion, the parts stock portion conveys the non-colored parts in accordance with the parts amount data toward the wiring harness assembling portion, and the wiring harness assembling portion has a second coloring unit to color outer surfaces of the non-colored parts, colors the outer surfaces of the non-colored parts supplied from the parts stock portion by using the second coloring unit, and attaches the colored parts to either the electric wires or the terminal fittings.

Accordingly, the wiring harness assembling portion sends the parts amount data indicating the required amount of the parts, in addition to the wire amount data, to the parts stock portion after the receipt of order from the ordering side. The parts stock portion, conveys the non-colored parts in accordance with the parts amount data toward the wiring harness assembling portion. Therefore, the amount of the parts, in addition to the amount of the electric wire, to be once stocked at the wiring harness assembling portion can be reduced. Further, the outer surfaces of the parts are colored after the receipt of order for the wiring harness. Therefore, the kind (color kind) of the parts to be stocked beforehand can be reduced.

The sub-harness is assembled by the sub-harness assembling portion after, for example, coloring the outer surfaces of the non-colored parts by the second coloring unit, and the sub-harnesses are assembled into the wiring harness by the wiring harness assembling portion. Therefore, the sub-harness, the electric wire, or the parts only has to be once stocked after the assembly of the sub-harness by the sub-harness assembling portion.

BEST MODE OF THE INVENTION

The first embodiment of the inventive wiring harness job-order production system will be described in reference to FIGS. 1 to 10. The wiring harness job-order production system 1 (FIG. 1) is a system for assembling a wiring harness 2 shown in FIG. 9.

Figure 9:
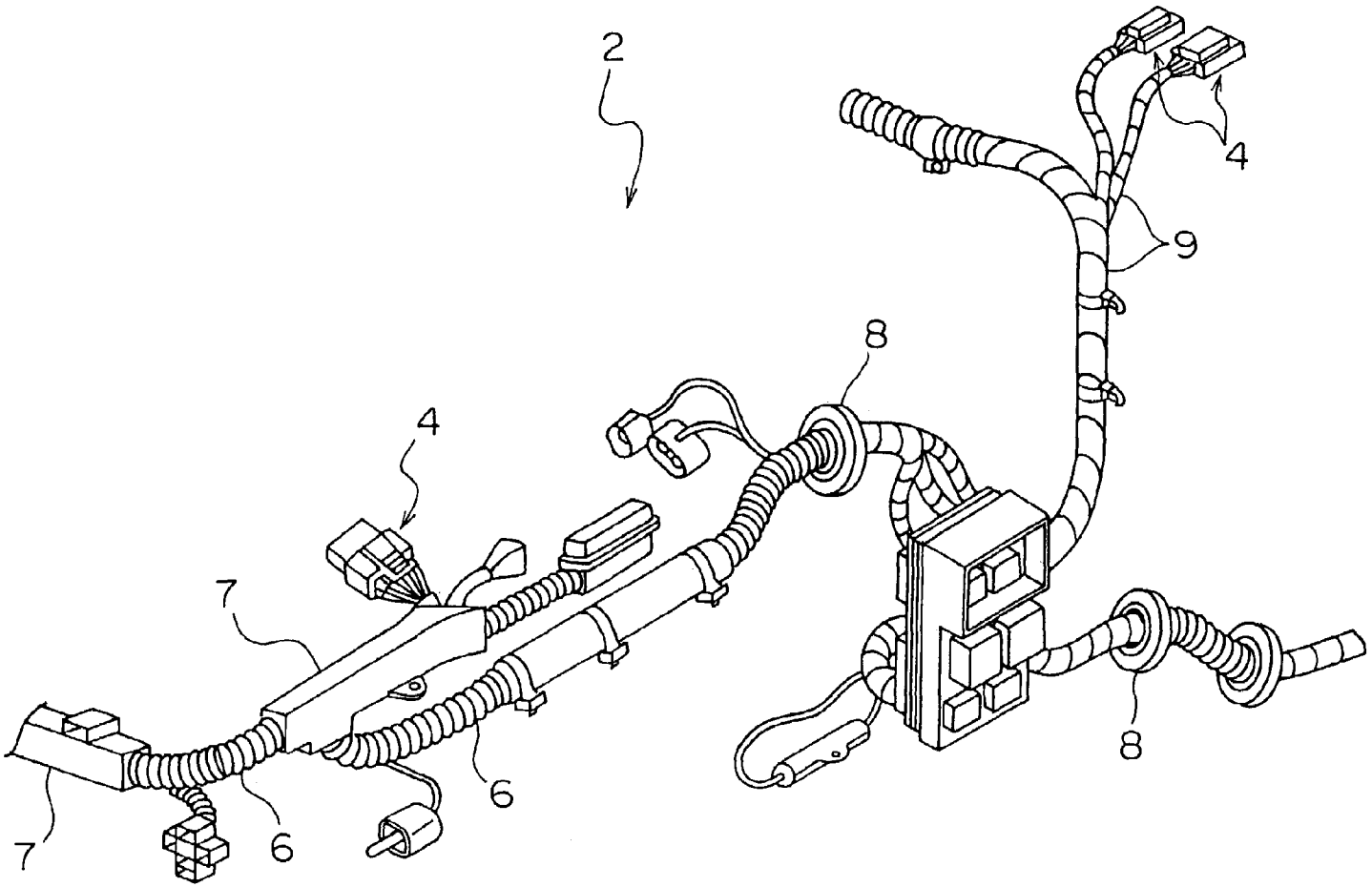
FIG. 9 is a perspective view showing the wiring harness assembled by the wiring harness job-order production system shown in FIG. 1.

The wiring harness 2 is arranged on a motor vehicle or the like. The wiring harness 2 has electric wires 3 (FIG. 10), connectors 4, a joint-terminal 5 (FIG. 10), tubes 6, protectors 7, grommets 8, and a tape 9 as shown in FIG. 9. The wiring harness 2 consists of the sub-harnesses 10 shown in FIG. 10. The sub-harness 10 shown in FIG. 10 has a plurality of electric wires 3, a plurality of connectors 4, and a joint-terminal 5.

The electric wire 3 has a conductive core wire and a covering portion, of insulative synthetic resin, covering the core wire. The electric wire 3 is the so-called covered wire. The electric wires 3 are bundled up. An outer surface 3*a* of the covering portion of each electric wire 3 is colored in a specified color.

The connector 4 has conductive terminal fittings 11 and an insulative connector housing 12. The terminal fitting 11 is formed by bending a conductive sheet metal. The terminal fitting 11 is attached to an end portion of the electric wire 3. The terminal fitting 11 is electrically connected with the core wire of the electric wire 3. The connector housing 12 is made of insulative synthetic resin in a box-shape. The connector housing 12 receives the terminal fittings 11.

The joint-terminal 5 is formed of a conductive sheet metal. The joint-terminal 5 electrically connects the core wires of the electric wires 3. The core wires of the electric wires 3 are exposed at a connecting portion by means of the joint-terminal 5. The joint-terminal 5 covers the exposed core wires. The joint-terminal 5 crimps the exposed core wires, while electrically connecting the electric wires 3.

In the sub-harness 2, the covering portions of the end portions of the electric wires 3 are removed. The terminal fitting 11 is crimped to the exposed core wire. The covering portion, of the electric wire 3, at the above connecting portion is removed. The core wire exposed from the connecting portion is crimped by the joint-terminal 5, and the electric wires 3 are connected. The terminal fitting 11 is inserted into the connector housing 12.

The tube 6 is made of insulative and elastic synthetic resin in a cylindrical shape or a bellows-shape. The tube 6 protects the electric wire 3 inside thereof. The protector 7 is made of insulative synthetic resin, having a gutter-like cross-section. The protector 7 accommodates the electric wire 3, and the tape 9 is wound around the protector 7.

The grommet 8 is made of insulative and elastic synthetic resin in a cylindrical shape or a bellows-shape. The grommet 8 lets the electric wire 3 pass therethrough and engages a hole of a panel forming a vehicle body, while exhibiting waterproofing and sound insulation property.

The tape 9 is made of flexible synthetic resin. An adhesive face is formed on one surface of the tape 9. The tape 9 is wound around the electric wires 3 or the above protector 7. Here, the above-described the connector housing 12, the tube 6, the protector 7, the grommet 8, and the tape 9 are the "parts" in this specification.

Figure 10:
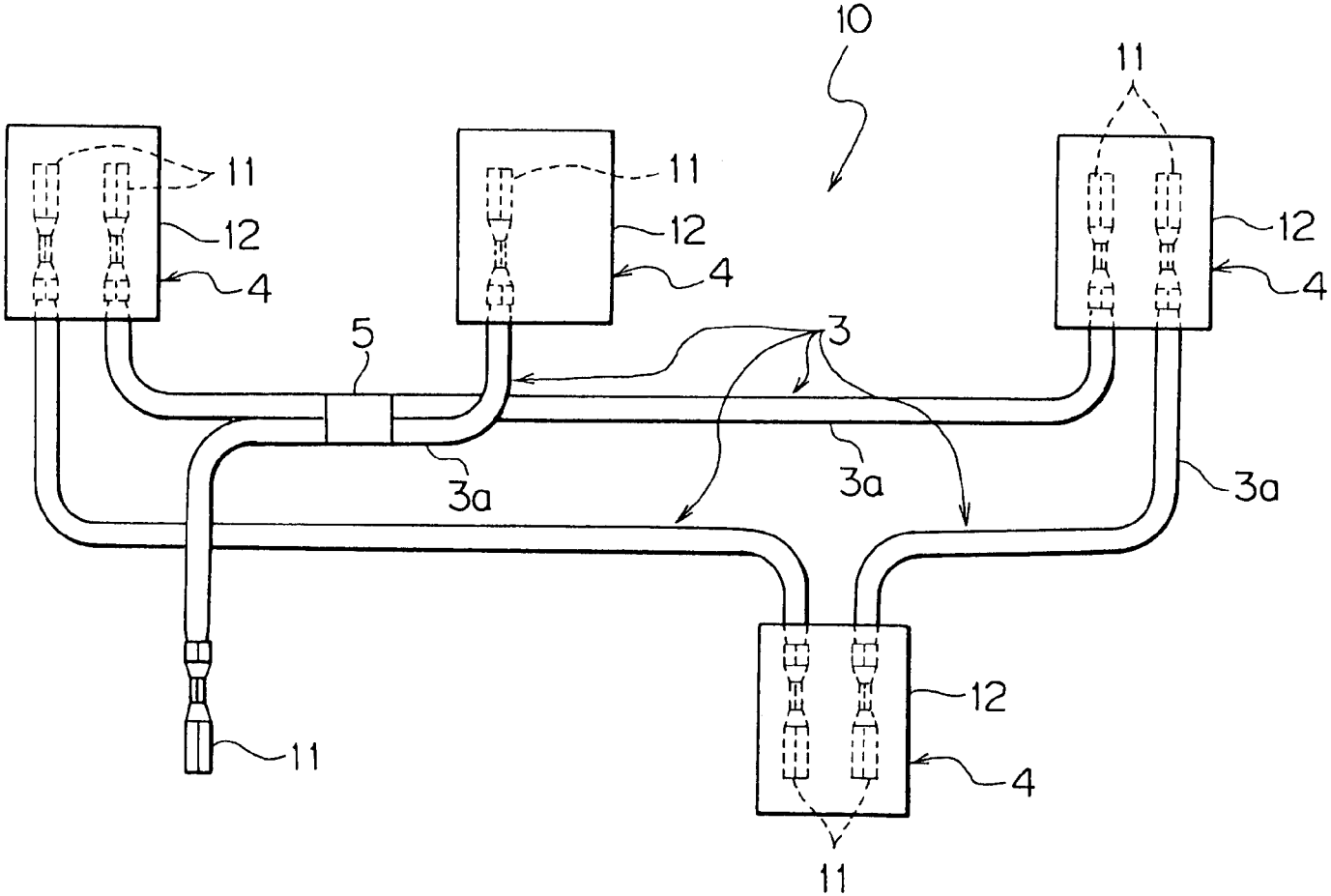
FIG. 10 is an explanatory illustration showing a structure of a sub-harness forming the wiring harness shown in FIG. 9.

When the wiring harness 2 with the above structure is assembled, the sub-harness 10 shown in FIG. 10 is assembled first. The electric wires 3 of the sub-harness 10 are bundled up, the tube 6, the protector 7, and the grommet 8 are attached to the electric wires 3, and the tape 9 is wound thereon. The wiring harness 2 is formed by assembling the sub-harnesses 10. The connectors 4 of the wiring harness 2 are connected to connectors of electronic equipment installed, for example, on a motor vehicle. The wiring harness 2 transmits the electric power or control signals between electronic equipment.

Figure 1:
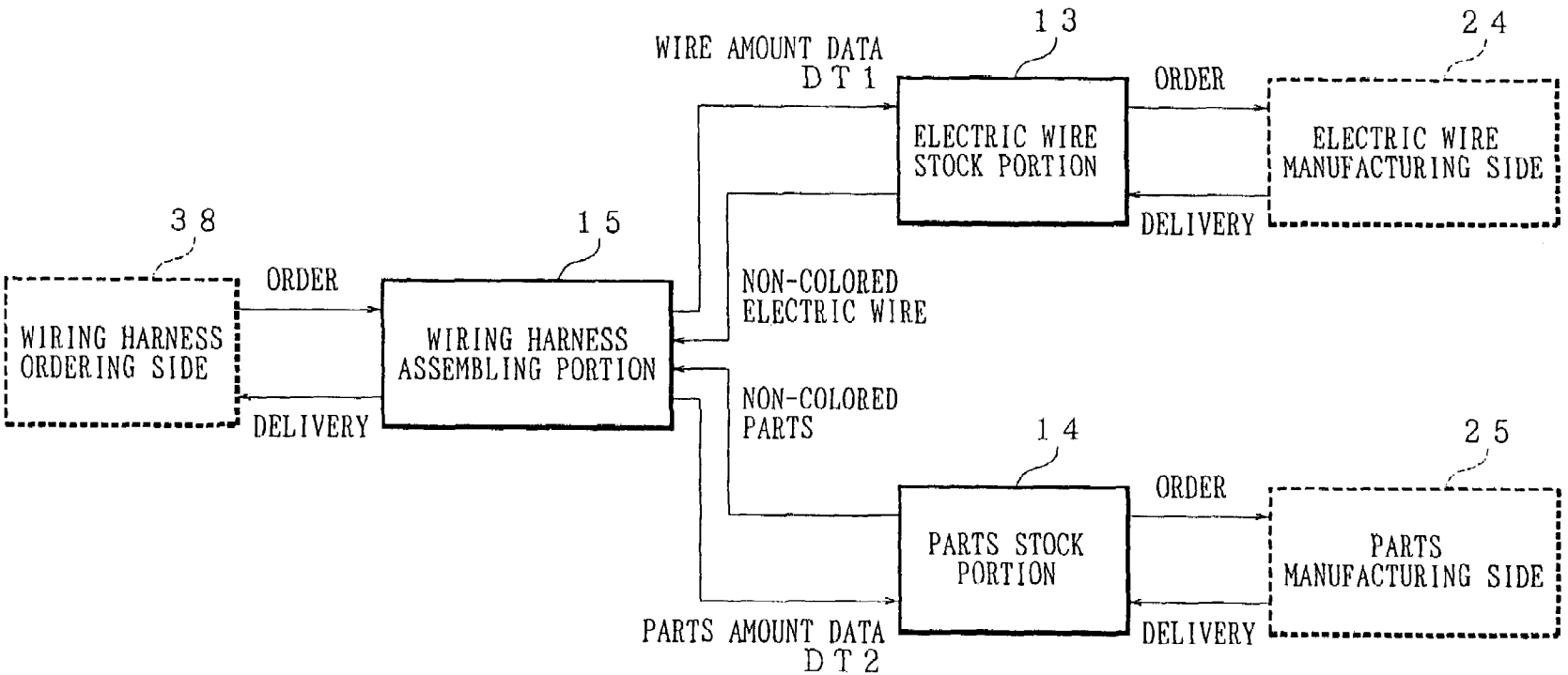
FIG. 1 is an explanatory illustration showing a basic structure of the first embodiment of the inventive wiring harness job-order production system.

The wiring harness job-order production system 1 is a system to assemble the above wiring harness 2. The wiring harness job-order production system 1 has an electric wire stock portion 13, a parts stock portion 14 and a wiring harness assembling portion 15 as shown in FIG. 1.

The electric wire stock portion 13 stocks the electric wire 3 whose covering portion is not colored (i.e. non-colored electric wire). The electric wire 3 is, for example, wound on a dram. The electric wire stock portion 13 stocks non-colored electric wires 3 with various core wire diameters, various covering portion diameters, and various covering portion materials with respective article numbers. The electric wire stock portion 13 orders necessary electric wires 3 from an electric wire manufacturing side (an electric wire factory) 24 as the need arises. Then, the electric wires 3 are supplied to the electric wire stock portion 13 from the electric wire manufacturing side 24.

The parts stock portion 14 stocks non-colored connector housings 12, non-colored tubes 6, non-colored protectors 7, non-colored grommets 8, non-colored tapes 9 and the terminal fittings 11. The parts stock portion 14 stocks these parts 12,6,7,8,9 and the terminal fittings 11 with respective article numbers. The parts stock portion 14 orders the parts 12,6,7,8,9 and the terminal fittings 11 from a parts manufacturing side (a parts factory) 25 as the need arises. The parts 12,6,7,8,9 and the terminal fittings 11 are supplied to the parts stock portion 14 from the parts manufacturing side 25.

Here, the "non-colored" state in this specification is a state that synthetic resin forming the covering portion of the electric wire 3 and the parts 12,6,7,8,9 is not mixed with the colorant or is not painted, and therefore the outer surface of the electric wire or of the parts has the color of the synthetic resin itself.

The wiring harness assembling portion 15 gets and keeps necessary kinds of non-colored electric wires 3 by at least necessary lengthes from the electric wire stock portion 13 after the receipt of order for the wiring harness 2. The wiring harness assembling portion 15 gets and keeps necessary kinds of non-colored parts 12,6,7,8,9 by necessary numbers from the parts stock portion 14 after the receipt of order for the wiring harness 2.

The wiring harness assembling portion 15 assembles the sub-harnesses 10. At this time, the covering portion of the electric wires 3 and the parts 12,6,7,8,9 are colored. Further, the wiring harness assembling portion 15 combines the sub-harnesses 10 into the wiring harness 2, carries out a conductivity test and an appearance inspection, and ships the assembled wiring harness 2.

Figure 2:
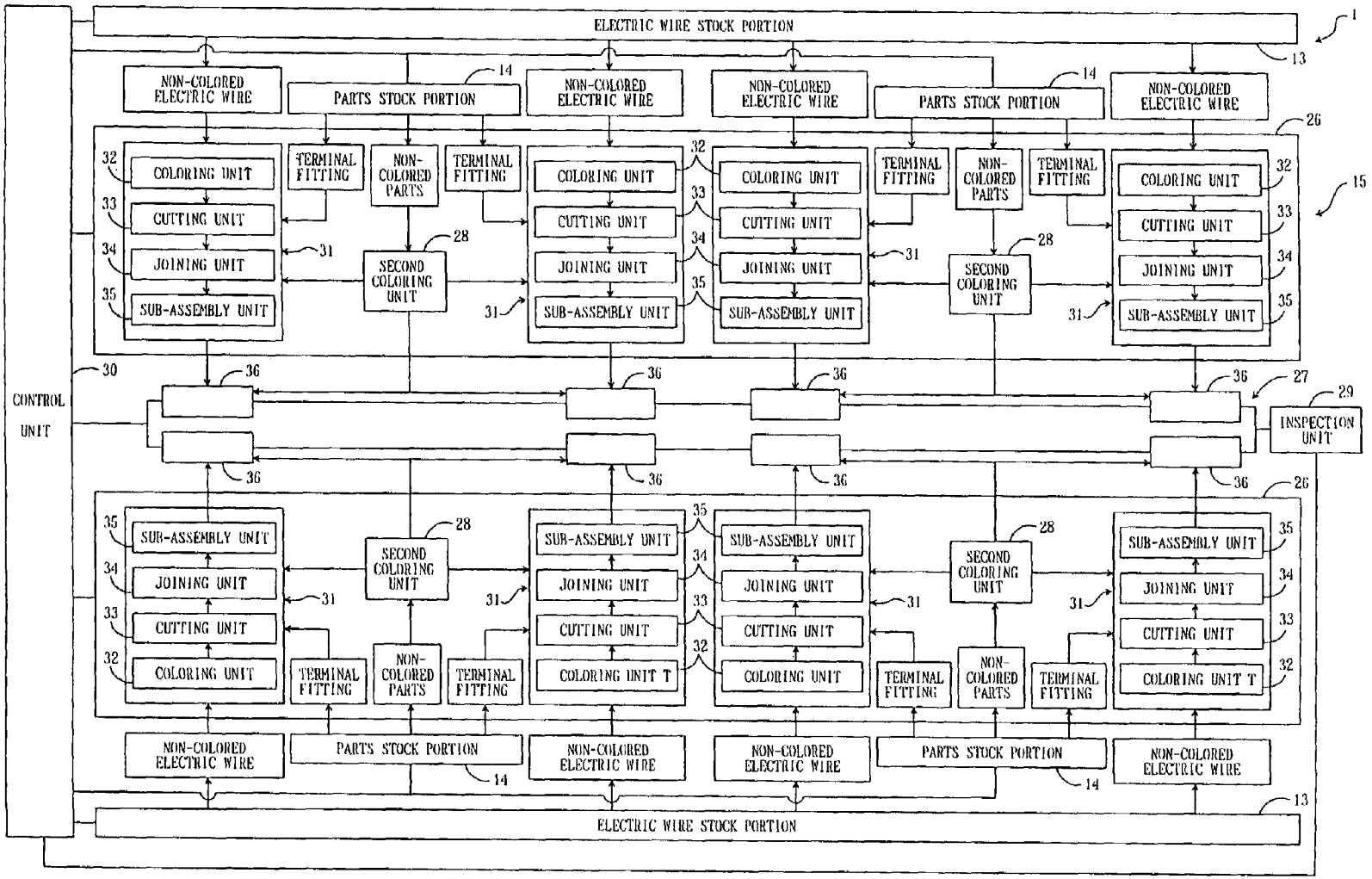
FIG. 2 is an explanatory illustration showing a basic structure of a wiring harness assembling portion of the wiring harness job-order production system shown in FIG. 1.

The wiring harness assembling portion 15 has, as shown in FIG. 2, a sub-harness assembly line 26, a wiring harness assembly line 27, a second coloring unit 28, an inspection unit 29, and a control unit 30 as a control system. The control unit 30 includes the sequence to supply all the necessary parts for the assembly of the wiring harness 2 toward each line 26,27 according to the order amount. The sub-harness assembly line 26 has a plurality of sub-harness assembling portions 31. Each sub-harness assembling portion 31 is supplied with the non-colored electric wire 3 from the electric wire stock portion 13 and with the terminal fitting 11 from the parts stock portion 14.

The sub-harness assembling portion 31 has a coloring unit 32, a cutting unit 33, a joining unit 34, and a sub-assembly unit 35. The coloring unit 32 is supplied with the non-colored electric wire 3 from the electric wire stock portion 13.

The coloring unit 32 paints the paint on the outer surface 3*a* of the covering portion of the electric wire 3 or dyes the outer surface 3*a* of the covering portion with the coloring liquid. That is, the coloring unit 32 colors the outer surface 3*a* of the covering portion of the electric wire 3 in a color P different from the color of the synthetic resin forming the covering portion.

In this specification, "to color the outer surface of the electric wire 3 and the parts 12,6,7,8,9" means to color the outer surface 3*a* of the covering portion of the electric wire 3 and the outer surfaces of the parts 12,6,7,8,9 with the colorant. The colorant is a liquid substance in which color material (organic substance for industry) is dissolved and dispersed in water or in other solvent. As the organic substance, there exists dyes and pigments (mostly organic substance and synthetic material). In the present specification, "colorant" means both the paint and the coloring liquid.

In the coloring liquid, the dye is dissolved or dispersed in the solvent. In the paint, the pigment is dispersed in the dispersion liquid. Therefore, when the outer surface 3*a* of the covering portion and the outer surfaces of the parts 12,6,7,8,9 are colored by the coloring liquid, the dye soaks into in the covering portion and the parts 12,6,7,8,9, and when the outer surface 3*a* of the covering portion and the outer surfaces of the parts 12,6,7,8,9 are colored by the paint, the pigment adheres to the outer surfaces without soaking therein. That is, "to color the outer surface 3*a* of the covering portion of the electric wire 3 and the outer surfaces of the parts 12,6,7,8,9" in the present specification means to dye the outer surface 3*a* of the covering portion of the electric wire 3 and the outer surfaces of the parts 12,6,7,8,9 with the dye and also to paint the pigment on the outer surface 3*a* of the covering portion of the electric wire 3 and the outer surfaces of the parts 12,6,7,8,9.

The solvent and the dispersion liquid should have an affinity for synthetic resin forming the covering portion of the electric wire 3 and the outer surfaces of the parts 12,6,7,8,9 so that the dye securely soaks into the covering portion of the electric wire 3 and the outer surfaces of the parts 12,6,7,8,9 and the pigment securely adheres to the outer surface 3*a* of the covering portion of the electric wire 3 and the outer surfaces of the parts 12,6,7,8,9.

At least one of the first to fourth coloring apparatuses 16,18,19,20 shown in FIGS. 5-8 is used as the coloring unit 32. That is, the sub-harness assembling portion 31 has at least one of the first to fourth coloring apparatuses 16,18, 19,20.

Figure 5A:
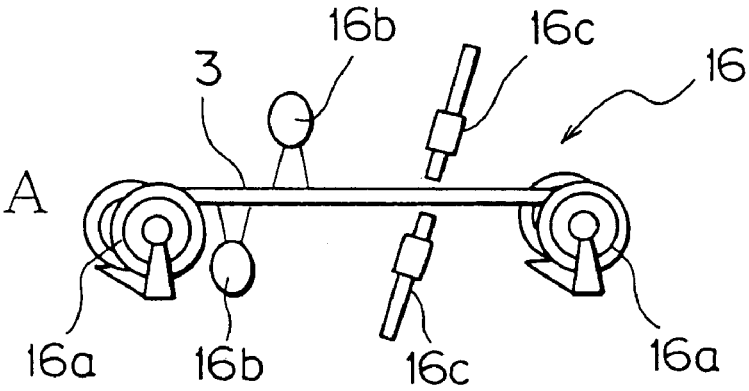
FIG. 5A is an explanatory illustration showing a first coloring apparatus of the wiring harness job-order production system shown in FIG. 1.

The first coloring apparatus 16 has a pair of rollers 16*a*, sprayers 16*b* and markers 16*c* as shown in FIG. 5A. The pair of rollers 16*a* are arranged with some interval, and the electric wire 3 is arranged between the rollers 16*a*.

A pair of sprayers 16*b* are provided in the illustrated embodiment. The sprayer 16*b* sprays the colorant toward the electric wire 3 traveling between the rollers 16*a*. The sprayers 16*b* color the outer surface 3*a* of the electric wire 3. The sprayers 16*b* color the outer surface 3*a* of the electric wire 3 in a color P different from the color of synthetic resin of the covering portion over the whole periphery of the electric wire 3.

A pair of markers 16*c* are provided in the illustrated embodiment. The markers 16*c* are arranged downstream of the sprayers 16*b* in a traveling direction of the electric wire 3. The marker 16*c* puts the colorant partly on the outer surface 3*a* of the electric wire 3, which colorant has a color R different from both the color P colored by the sprayer 16*b* and the color of synthetic resin itself.

Figure 5B:
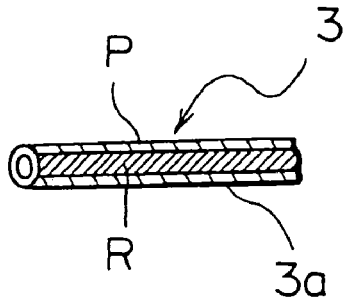
FIG. 5B is a perspective view of an electric wire colored by the first coloring apparatus of FIG. 5A.

With the first coloring apparatus 16, the sprayer 16*b* colors the outer surface 3*a* of the electric wire 3 in the color P (the hatching in the figure) over the whole periphery, and the marker 16*c* colors the outer surface 3*a* in the color R different from both the color P and the color of synthetic resin. The first coloring apparatus 16 colors the outer surface 3*a* of the electric wire 3 in a stripe pattern with the colors P,R as shown in FIG. 5B.

Figure 6A:
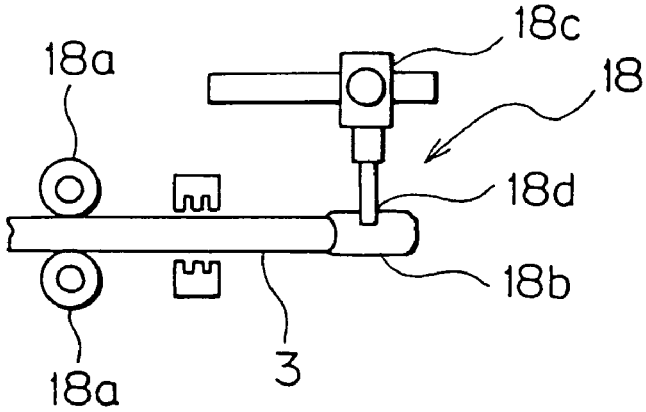
FIG. 6A is an explanatory illustration showing a second coloring apparatus of the wiring harness job-order production system shown in FIG. 1.

The second coloring apparatus 18 has a pair of running rollers 18*a*, a tubular member 18*b* and a coloring portion 18*c* as shown in FIG. 6A. The pair of running rollers 18*a* put the electric wire 3 therebetween to run the electric wire 3.

The tubular member 18*b* is formed tubularly in order to receive an end portion of the electric wire 3. The tubular member 18*b* is provided with a through-hole 18*d*. The coloring portion 18*c* partly puts the paint or the coloring liquid on the outer surface 3*a* of the electric wire 3 in the tubular member 18*b* through the through-hole 18*d*. The coloring portion 18*c* partly colors the outer surface 3*a* of the electric wire 3 in a color S (the hatching in the figure) different from the color of synthetic resin forming the covering portion and the colors P,R.

Figure 6B:
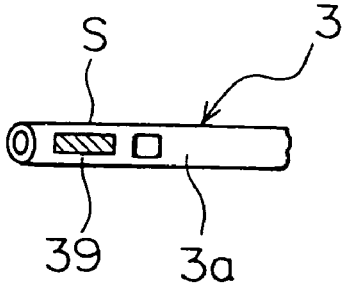
FIG. 6B is a perspective view of an electric wire colored by the second coloring apparatus of FIG. 6A.

In the second coloring apparatus 18, the coloring portion 18*c* partly colors the outer surface 3*a* of the electric wire 3 in the color S different from the color of the synthetic resin and the colors P,R. The second coloring apparatus 18 colors a portion of the outer surface 3*a* of the electric wire 3 in the above color S to form a mark 39 as shown in FIG. 6B.

Figure 7A:
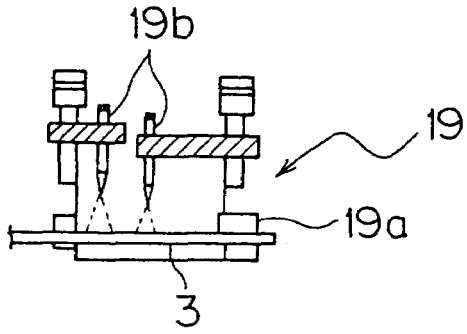
FIG. 7A is an explanatory illustration showing a third coloring apparatus of the wiring harness job-order production system shown in FIG. 1.

The third coloring apparatus 19 has an electric wire damper 19*a* and sprayers 19*b* as shown in FIG. 7A. The electric wire clamper 19*a* clamps an end portion of the electric wire 3. The sprayer 19*b* sprays the paint or the coloring liquid on a portion of the outer surface 3*a* of an end portion of the electric wire 3. The sprayer 19*b* partly colors the outer surface 3*a* of the electric wire 3 in the color S (the hatching in the figure) different from the color of synthetic resin forming the covering portion and the colors P,R.

Figure 7B:
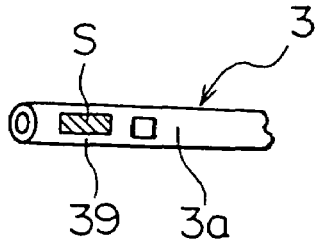
FIG. 7B is a perspective view of an electric wire colored by the third coloring apparatus of FIG. 7A.

In the third coloring apparatus 19, the sprayer 19*b* partly colors the outer surface 3*a* of the electric wire 3 in the color S different from the color of synthetic resin forming the covering portion and the colors P,R as shown in FIG. 7B. The third coloring apparatus 19 colors a portion of the outer surface 3*a* of the electric wire 3 in the above color S to form a mark 39 as shown in FIG. 7B.

Figure 8A:
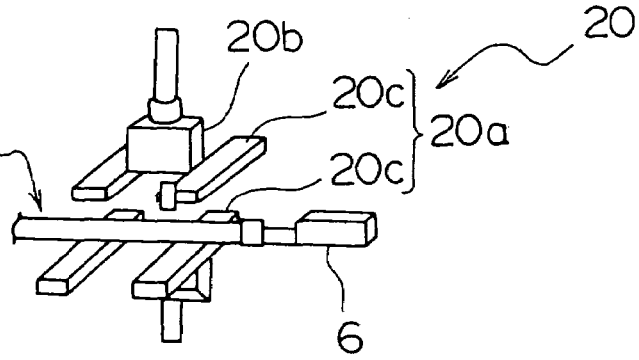
FIG. 8A is an explanatory illustration showing a fourth coloring apparatus of the wiring harness job-order production system shown in FIG. 1.

The fourth coloring apparatus 20 has electric wire clampers 20*a* and a stamper 20*b* as shown in FIG. 8A. The electric wire clamper 20*a* has holding members 20*c*,20*c* which close and open each other. The electric wire damper 20*a* sandwiches an end portion of the electric wire 3 between the holding members 20*c*,20*c*. The electric wire damper 20*a* clamps the end portion of the electric wire 3.

The stamper 20*b* moves relative to the end portion of the electric wire 3 along with the holding members 20*c*,20*c*. That is, the stamper 20*b* approaches the end portion of the electric wire 3 when the holding members 20*c*,20*c* close each other. The stamper 20*b* is put into contact with the end portion and partly puts a colorant on the outer surface 3*a* of the end portion. The stamper 20*b* partly colors the outer surface 3*a* of the electric wire 3 in the color S (the hatching in the figure) different from the color of synthetic resin forming the covering portion and the colors P,R.

Figure 8B:
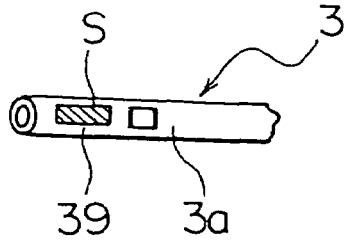
FIG. 8B is a perspective view of an electric wire colored by the fourth coloring apparatus of FIG. 8A.

In the fourth coloring apparatus 20, the stamper 20*b* partly colors the outer surface 3*a* of the electric wire 3 in the color S different from the color of synthetic resin forming the covering portion and the colors P,R. The fourth coloring apparatus 10 colors a portion of the outer surface 3*a* of the electric wire 3 in the above color S to form a mark 39 as shown in FIG. 8B.

As the coloring unit 32, fifth and sixth coloring apparatuses 21,22 of the later-described second embodiment and the above-described second to fourth coloring apparatuses 18,19,20 may be combined. In this case, the outer surface 3*a* of the covering portion of the electric wire 3 is colored in the color P by the fifth coloring apparatus 21 or the sixth coloring apparatus 22, and then a portion of the outer surface 3*a* is colored in the color S by using any of the second to fourth coloring apparatuses 18,19,20, so as to form the mark 39.

The cutting unit 33 is supplied with the electric wire 3, whose the outer surface 3*a* is colored, from the coloring unit 32. That is, the covering portion of the electric wire 3 supplied to the cutting unit 33 is colored in a specified color with the pigment or the dye.

The cutting unit 33 cuts off the electric wire 3 in a specified length. The cutting unit 33 removes the covering portion at an end portion of the electric wire 3 having been cut off. The cutting unit 33 attaches the terminal fitting 11 to the end portion of the electric wire 3.

The electric wire 3 to which the terminal fitting 11 and the like have been attached at the cutting unit 33 is supplied to the joining unit 34 from the cutting unit 33. The joining unit 34 removes the covering portion of the above connecting portion of the electric wire 3. The joining unit 34 crimps the core wires by means of the joint-terminal 5 so as to connect the electric wires 3.

The electric wire 3 to which the terminal fitting 11 is attached is supplied from the joining unit 34 to the sub-assembly unit 35. The sub-assembly unit 35 inserts the terminal fitting 11 attached to the end portion of the electric wire 3 into the connector housing 12. The sub-assembly unit 35 assembles the connector 4 by inserting the terminal fitting 11 into the connector housing 12.

The wiring harness assembly line 27 has a plurality of wiring boards 36. The wiring board 36 travels on the floor of a factory along, for example, circular rails (not shown).

Outer shapes of the parts 12,6,7,8,9 such as the connector housing 12 and an arrangement pattern of the electric wires 3 are drawn on the surface of the wiring board 36. Fastening tools (not shown) are arranged on the wiring board 36 so as to fasten the electric wires 3 of the sub-harness 10 according to the above arrangement pattern.

Non-colored parts 12,6,7,8,9 are supplied to the second coloring unit 28 from the parts stock portion 14. The second coloring unit 28 colors (i.e. paints or dyes) the outer surfaces of the parts 12,6,7,8,9 in respective colors different from the color of synthetic resin forming the parts 12,6,7,8,9. The second coloring unit 28 conveys the colored parts 12,6,7,8,9 toward the sub-harness assembling portions 31 or the wiring harness assembly line 27.

The assembled wiring harness 2 is supplied to the inspection unit 29 from the wiring harness assembly line 27. The inspection unit 29 carries out a conductivity test on the wiring harness 2. At this time, an appearance inspection is visibly carried out.

Figure 3:
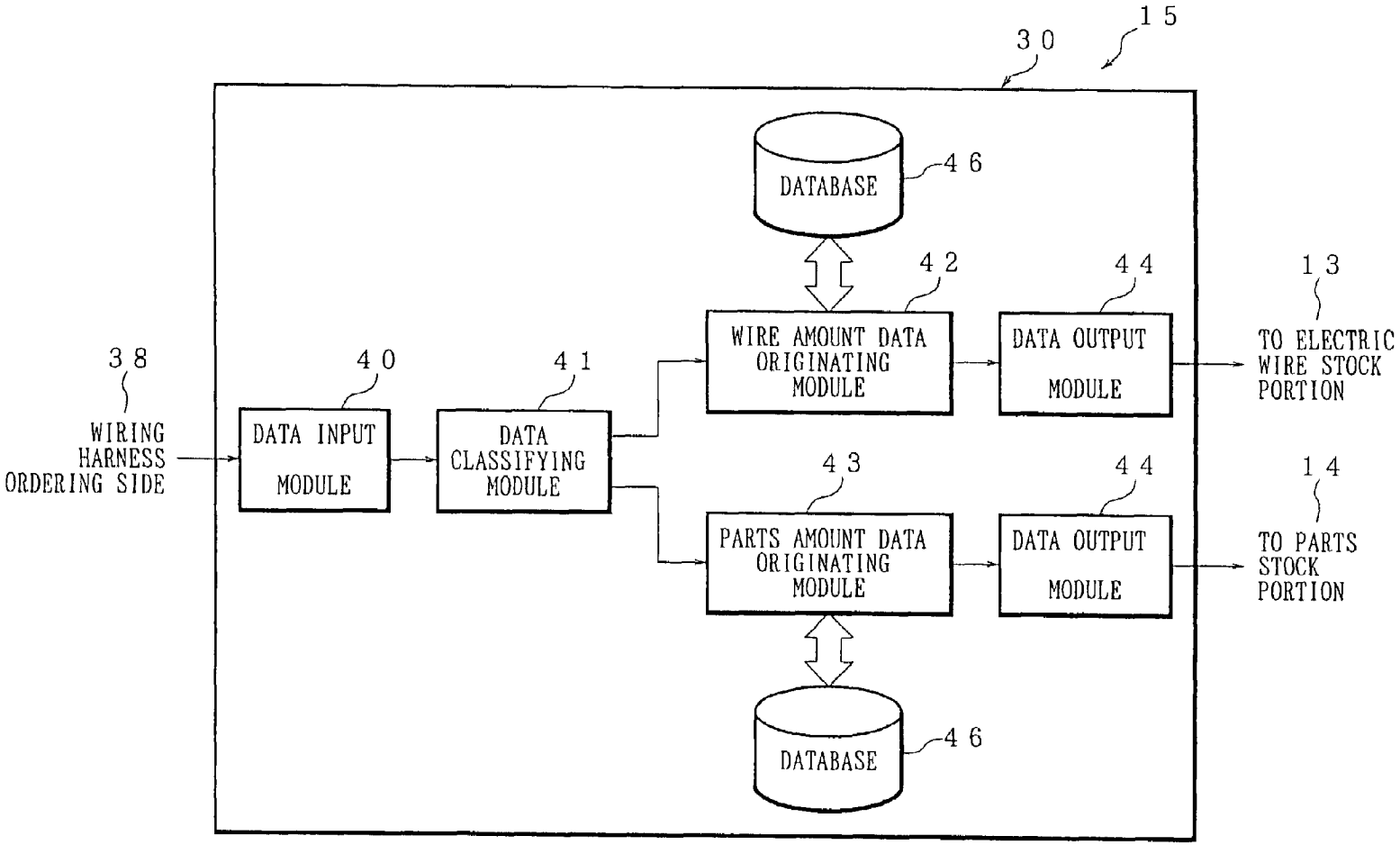
FIG. 3 is an explanatory illustration showing a basic structure of a control unit of the wiring harness assembling portion shown in FIG. 2.

The control unit 30 is a computer having well-known RAM, ROM, and CPU. The control unit 30 is connected with the sub-harness assembly line 26, the wiring harness assembly line 27, the second coloring unit 28, and the inspection unit 29, and controls the whole wiring harness assembling portion 15, i.e. the whole wiring harness job-order production system 1. The control unit 30 includes the sequence to supply all the necessary parts for the assembly of the wiring harness 2 toward each line 26,27 according to the order amount. The control unit 30 has a data input module 40 to which data is inputted, a data classifying module 41, a wire amount data originating module 42, a parts amount data originating module 43, a data output module 44, and so on as shown in FIG. 3.

Data of the order amount and the structure of the wiring harness 2 is inputted to the data input module 40 by, for example, a wiring harness ordering side (a motor vehicle manufacturer) 38. The structure of the wiring harness 2 means the article number and the amount (the number and the length) of the electric wire 3 and the article number and the amount (the number) of each of the parts 12,6,7,8,9.

Data of the order amount and the structure of the wiring harness 2 is inputted to the data classifying module 41 through the data input module 40. The data classifying module 41 separates the above data into data about the electric wire 3 and data about the parts 12,6,7,8,9. The data classifying module 41 outputs the data about the electric wire 3 toward the wire amount data originating module 42 and outputs the data about the parts 12,6,7,8,9 and the terminal fitting 11 toward the parts amount data originating module 43.

The wire amount data originating module 42 deciphers the data about the electric wire 3 by using a program stored in a database 46, calculates the size (wire diameter) and the length of the required electric wire 3, and makes wire amount data DT1. That is, the wire amount data DT1 includes the size (wire diameter) and the length of each electric wire 3 required for the wiring harness 2. The wire amount data originating module 42 outputs the wire amount data DT1 toward the electric wire stock portion 13 through the data output module 44. That is, the wiring harness assembling portion 15 sends the wire amount data DT1 to the electric wire stock portion 13.

The parts amount data originating module 43 deciphers the data about the parts 12,6,7,8,9 and the terminal fitting 11 by using a program stored in the database 46, calculates the article number and the amount of each of the parts 12,6,7,8,9, and makes parts amount data DT2. That is, the parts amount data DT2 includes the article number and the amount of each of the parts 12,6,7,8,9. The parts amount data originating module 43 outputs the parts amount data DT2 toward the parts stock portion 14 through the data output module 44. That is, the wiring harness assembling portion 15 sends the parts amount data DT2 to the parts stock portion 14. The parts amount data originating module 43 makes data indicating the article number and the amount of required terminal fitting 11 and outputs the data toward the parts stock portion 14 through the data output module 44.

Figure 4:
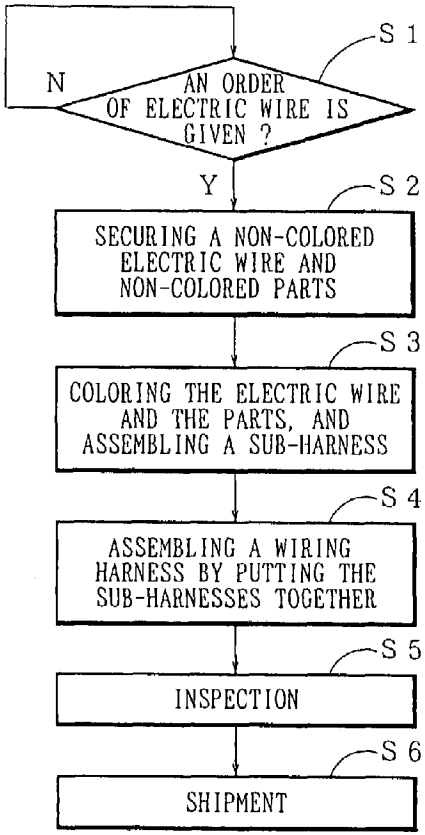
FIG. 4 is a flowchart for manufacturing a wiring harness by the wiring harness job-order production system shown in FIG. 1.
Figure 16:
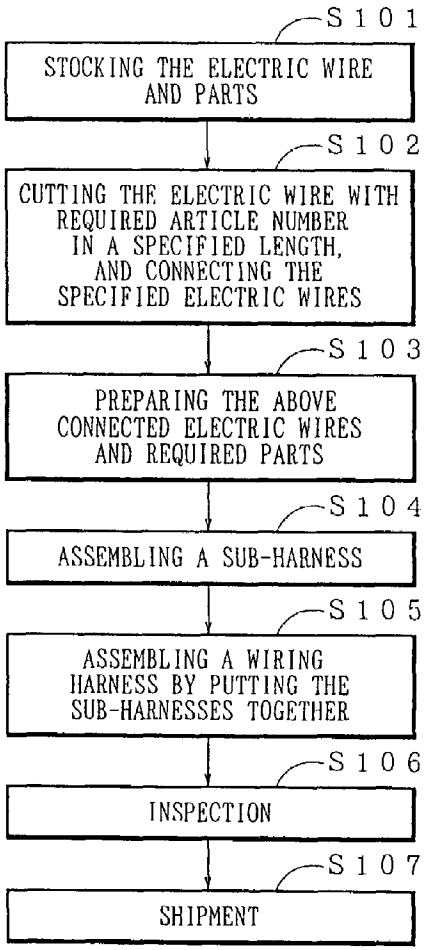
FIG. 16 is a flowchart showing a prior art steps for manufacturing a wiring harness.

In producing the wiring harness 2 by using the wiring harness job-order production system 1, firstly Step S1 in FIG. 4 judges whether or not an order of the wiring harness 2 has been given. When an order of the wiring harness 2 has not been given, Step S1 is repeated. When an order of the wiring harness 2 is given, Step S2 is reached.

At Step S2, data of the order amount and the structure of the wiring harness 2 is inputted to the control unit 30 of the wiring harness assembling portion 15 by, for example, a wiring harness ordering side (a motor vehicle manufacturer) 38. The control unit 30 makes the wire amount data DT1 indicating the size (wire diameter) and the length of the electric wire 3 required for the wiring harness 2 and outputs the wire amount data DT1 toward the electric wire stock portion 13. The required non-colored electric wire 3 is conveyed toward the wiring harness assembling portion 15 from the electric wire stock portion 13.

The control unit 30 makes the parts amount data DT2 indicating the article number and the amount of each of the parts 12,6,7,8,9 required for the wiring harness 2 and outputs the parts amount data DT2 toward the parts stock portion 14. The control unit 30 outputs data of the terminal fitting 11 required for the wiring harness 2 toward the parts stock portion 14. The required non-colored parts 12,6,7,8,9 and terminal fitting 11 are conveyed toward the wiring harness assembling portion 15 from the parts stock portion 14. As above, at Step S2 the wiring harness assembling portion 15 secures the necessary non-colored electric wire 3 and non-colored parts 12,6,7,8,9, and Step S3 is reached.

At Step S3, the coloring unit 32 of each sub-harness assembling portion 31 of the sub-harness assembly line 26 colors the outer surface 3*a* of the non-colored electric wire 3, and the second coloring unit 28 colors the non-colored parts 12,6,7,8,9. The cutting unit 33 cuts off the electric wire 3 having been colored by the coloring unit 32 in specified lengthes, removes the end portion of the covering portion, and attaches the terminal fitting 11 to the end portion. The joining unit 34 removes the covering portion of the connecting portion of the electric wire 3 and connects the electric wires 3 with the joint-terminal 5 if necessary. The sub-assembly unit 35 inserts the terminal fitting 11 attached to the end portion of the electric wire 3 into the connector housing 12. As above, the sub-harness 10 is assembled, and Step S4 is reached.

At Step S4, the sub-harness 10 is supplied to the wiring harness assembly line 27 from the sub-harness assembly line 26, and the colored parts 12,6,7,8,9 are also supplied from the second coloring unit 28 if necessary. At the wiring harness assembly line 27, a worker attaches the sub-harness 10 to the wiring board 36, and the parts 12,6,7,8,9 are attached to the sub-harness 10. The wiring harness assembly line 27 combines the sub-harnesses 10 thereby to assemble the wiring harness 2, and Step S5 is reached.

At Step S5, a conductivity test and an appearance inspection are carried out on the wiring harness 2 by the inspection unit 29, and Step S6 is reached. At Step S6, a non-defective wiring harness 2 is shipped to the wiring harness ordering side (motor vehicle manufacturer) 38.

According to the present embodiment, the non-colored electric wire 3 is secured by a required length after the receipt of order for the wiring harness 2, and the non-colored parts 12,6,7,8,9 are secured also after the receipt of order for the wiring harness 2. Therefore, the amount (length) of the electric wire 3 stocked beforehand and the amount of the parts 12,6,7,8,9 stocked beforehand can be reduced.

The non-colored electric wire 3 and the non-colored parts 12,6,7,8,9 are colored. Therefore, the kind (color kind) of the electric wire 3 and the parts 12,6,7,8,9 to be stocked beforehand can be reduced.

The non-colored electric wire 3 is colored by the coloring unit 32 of each sub-harness assembling portion 31 of the sub-harness assembly line 26, the parts 12,6,7,8,9 are colored by the second coloring unit 28, the sub-harness 10 is assembled, and the sub-harnesses 10 are assembled into the wiring harness 2 at the wiring harness assembly line 27.

Therefore, the electric wire 3 is stocked only in the electric wire stock portion 13, and the sub-harness 10 is once stocked only between the sub-harness assembly line 26 and the wiring harness assembly line 27. The non-colored parts 12,6,7,8,9 are directly supplied to the second coloring unit 28 from the parts stock portion 14. The colored parts 12,6,7,8,9 are directly supplied to the sub-harness assembling portion 31 or the wiring harness assembly line 27 from the second coloring unit 28. Therefore, the parts 12,6,7,8,9 only have to be stocked in the parts stock portion 14 and only have to be once stocked after the second coloring unit 28 and after the sub-harness assembling portion 31.

Therefore, the space for stocking the electric wire 3 and the parts 12,6,7,8,9 beforehand can be reduced. The space for once stocking the electric wire 3, the sub-harness 10, and the parts 12,6,7,8,9 during the manufacture can be reduced. Therefore, the production efficiency of the wiring harness 2 can be improved.

Figure 11:
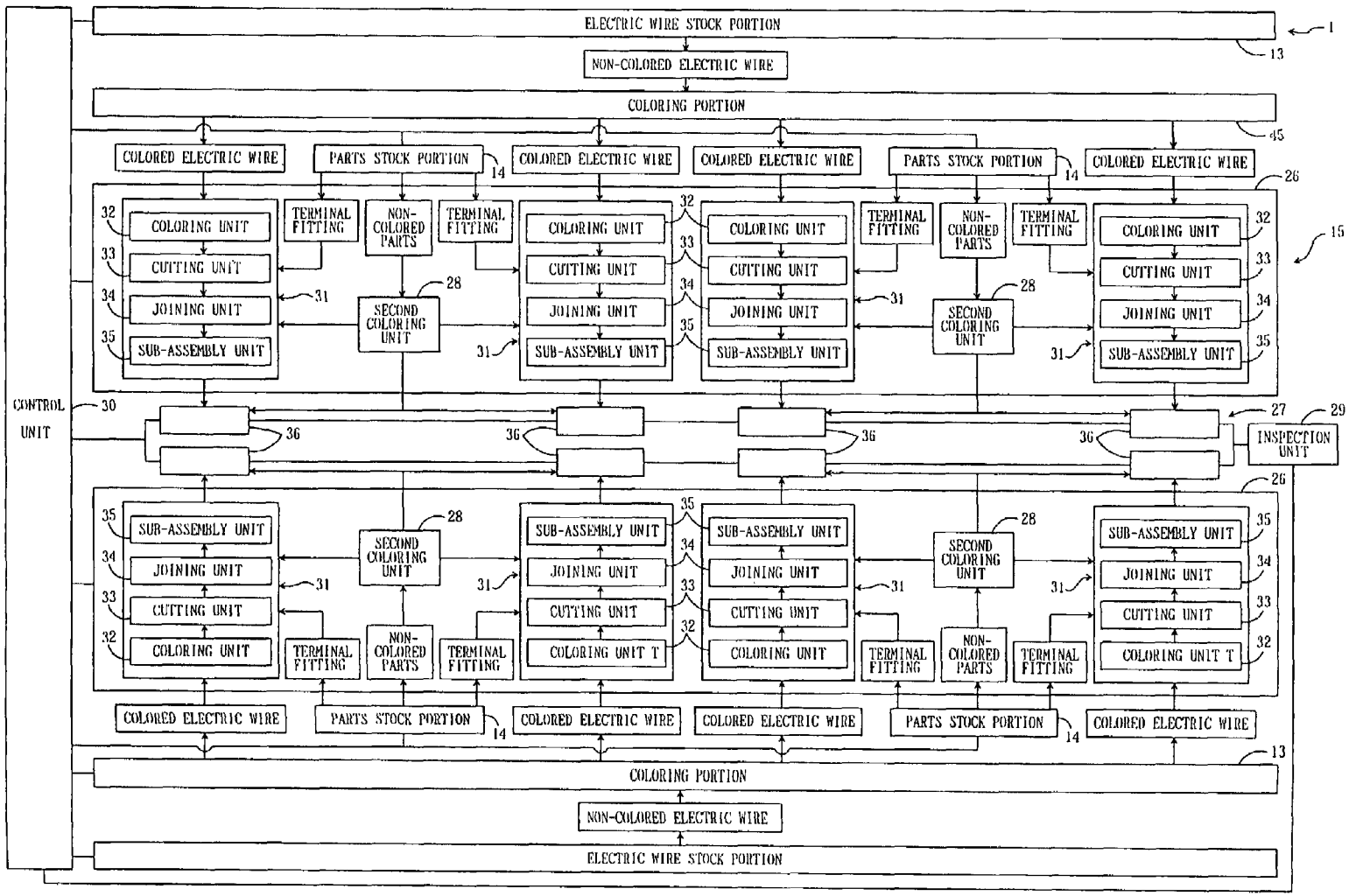
FIG. 11 is an explanatory illustration showing a basic structure of a wiring harness assembling portion of the second embodiment of the inventive wiring harness job-order production system.

Next, the second embodiment of the inventive wiring harness job-order production system will be described in reference to FIGS. 11 to 15. Here, the same references are assigned to the same elements as those of the first embodiment, and the description is omitted. In the present embodiment, the wiring harness assembling portion 15 has a coloring portion 45 as shown in FIG. 11.

The non-colored electric wire 3 is supplied to the coloring portion 45 from the electric wire stock portion 13. The coloring portion 45 is controlled by the control unit 30. The coloring portion 45 colors (paints or dyes) the outer surface 3*a* of the covering portion of the non-colored electric wire 3. The coloring portion 45 conveys the colored electric wire 3 toward the coloring unit 32 of each sub-harness assembling portion 31 of the sub-harness assembly line 26.

At least one of the fifth to seventh coloring apparatuses 21,22,23 shown in FIGS. 12-14 is used as the coloring portion 45. That is, the sub-harness assembling portion 15 has at least one of the fifth to seventh coloring apparatuses 21,22,23.

Figure 12A:
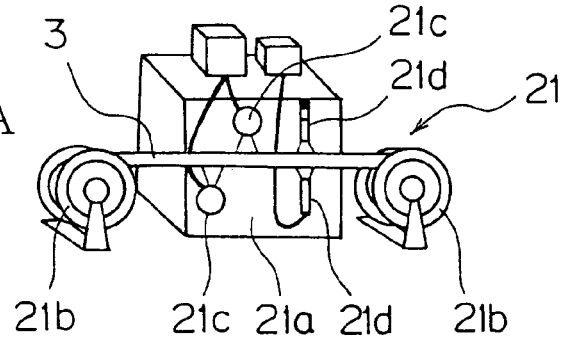
FIG. 12A is an explanatory illustration showing a fifth coloring apparatus of the wiring harness job-order production system of the second embodiment.

The first coloring apparatus 21 has an apparatus body 21*a*, a pair of rollers 21*b*, sprayers 21*c* and driers 21*d* as shown in FIG. 12A. The pair of rollers 21*b* are arranged with some interval, and the electric wire 3 is arranged between the rollers 21*b*.

A pair of sprayers 21*c* are provided in the illustrated embodiment. The sprayer 21*c* sprays the colorant (the paint or the coloring liquid) toward the electric wire 3 traveling between the rollers 21*c*. The sprayers 21*c* color (paint or dye) the outer surface 3*a* of the electric wire 3 over the whole periphery thereof. The sprayers 21*c* color the outer surface 3*a* of the electric wire 3 in a color P different from the color of synthetic resin of the covering portion over the whole periphery of the electric wire 3.

Figure 12B:
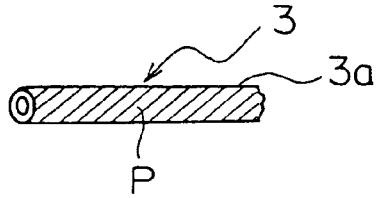
FIG. 12B is a perspective view of an electric wire colored by the fifth coloring apparatus of FIG. 12A.

The drier 21*d* is arranged downstream of the sprayers 21*c* in a traveling direction of the electric wire 3. The drier 21*d* dries the colorant blown on the outer surface of the electric wire 3 by the sprayers 21*c*. The painting device 14 of the above structure colors the outer surface of the electric wire 3 in a color P (a hatched portion in FIG. 3*b*) different from a color of synthetic resin of the covering portion over the whole periphery of the electric wire 3. The fifth coloring apparatus 21 with the above structure colors the outer surface 3*a* of the electric wire 3 in a color P (the hatching in the figure) over the whole periphery as shown in FIG. 12B.

Figure 13A:
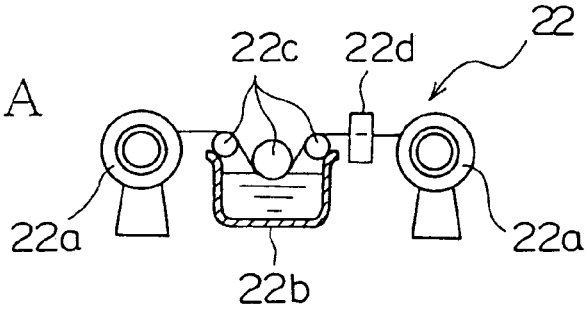
FIG. 13A is an explanatory illustration showing a sixth coloring apparatus of the wiring harness job-order production system of the second embodiment.

The sixth coloring apparatus 22 has a pair of rollers 22*a*, an impregnating tank 22*b*, guide-rollers 22*c*, and a squeegee 22*d* as shown in FIG. 13A. The pair of rollers 22*a* are arranged with some interval, and the electric wire 3 is arranged between the rollers 22*a*.

The impregnating tank 22*b* is arranged between the pair of rollers 22*a*. The impregnating tank 22*b* is formed in a box-shape with a top opening. The impregnating tank 22*b* receives the coloring liquid or the paint with a color P different from synthetic resin forming the covering portion. The guide-rollers 22*c* are arranged between the pair of rollers 22*a* with some intervals in a traveling direction of the electric wire 3. The guide-rollers 22*c* lead the electric wire 3 into the impregnating tank 22*b* such that the electric wire 3 is put in the coloring liquid or the paint.

The squeegee 22*d* is arranged downstream of the impregnating tank 22*b*. The squeegee 22*d* removes extra colorant from the outer surface 3*a* of the electric wire 3.

Figure 13B:
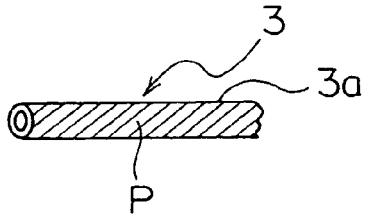
FIG. 13B is a perspective view of an electric wire colored by the sixth coloring apparatus of FIG. 13A.

The sixth coloring apparatus 22 colors the outer surface 3*a* of the electric wire 3 in the color P (the hatching in the figure) over the whole periphery by putting the electric wire 3 in the impregnating tank 22*b* as shown in FIG. 13B.

Figure 14A:
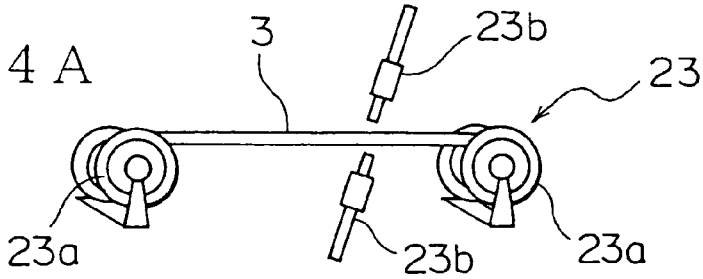
FIG. 14A is an explanatory illustration showing a seventh coloring apparatus of the wiring harness job-order production system of the second embodiment.

The seventh coloring apparatus 23 has a pair of rollers 23*a* and markers 23*b* as shown in FIG. 14A. The pair of rollers 23*a* are arranged with some interval, and the electric wire 3 is arranged between the rollers 23*a*.

A pair of markers 23*b* are provided in the illustrated embodiment. The marker 23*b* is put into contact with the outer surface 3*a* of the electric wire 3 and puts the paint or the coloring liquid on a portion of the outer surface 3*a* of the electric wire 3.

The pair of the markers 23*b* colors the portion of the outer surface 3*a* of the electric wire 3 in a color R different from the color of synthetic resin forming the covering portion.

Figure 14B:
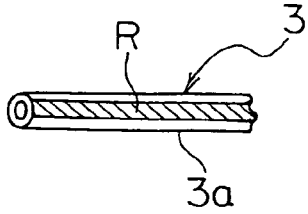
FIG. 14B is a perspective view of an electric wire colored by the seventh coloring apparatus of FIG. 14A.

The seventh coloring apparatus 23 with the above structure colors the portion of the outer surface 3*a* of the electric wire 3 in the color R different from the color of synthetic resin forming the covering portion by using the markers 23*b* as shown in FIG. 14B. The seventh coloring apparatus 23 colors the outer surface 3*a* of the electric wire 3 in a stripe pattern with the color R as shown in FIG. 14B.

Figure 15:
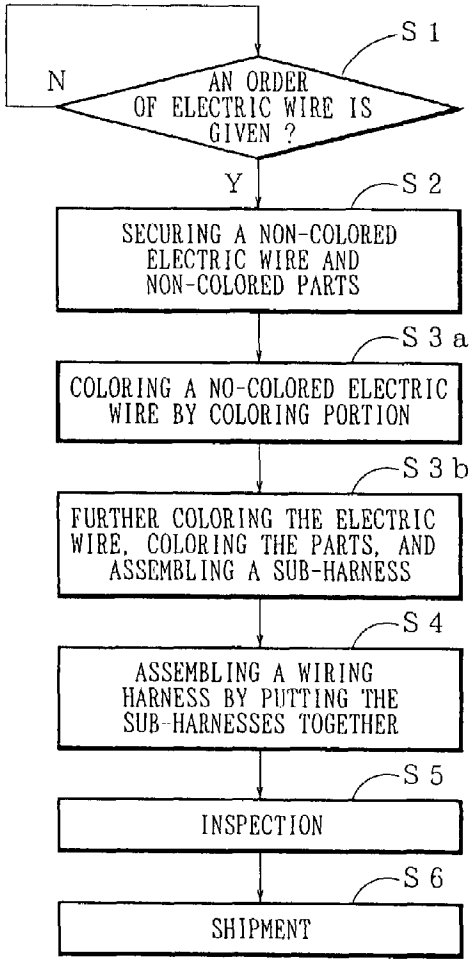
FIG. 15 is a flowchart for manufacturing a wiring harness by the wiring harness job-order production system of the second embodiment.

In producing the wiring harness 2 by using the wiring harness job-order production system 1 of the present embodiment, firstly Step S1 in FIG. 15 judges whether or not an order of the wiring harness 2 has been given. When an order of the wiring harness 2 has not been given, Step S1 is repeated. When an order of the wiring harness 2 is given, Step S2 is reached.

At Step S2, data of the order amount and the structure of the wiring harness 2 is inputted to the control unit 30 of the wiring harness assembling portion 15 by, for example, a wiring harness ordering side (a motor vehicle manufacturer) 38. The control unit 30 makes the wire amount data DT1 indicating the size (wire diameter) and the length of the electric wire 3 required for the wiring harness 2 and outputs the wire amount data DT1 toward the electric wire stock portion 13. The required non-colored electric wire 3 is conveyed toward the coloring portion 45 from the electric wire stock portion 13.

The control unit 30 makes the parts amount data DT2 indicating the article number and the amount (per each article number) of each of the parts 12,6,7,8,9 required for the wiring harness 2 and outputs the parts amount data DT2 toward the parts stock portion 14. The control unit 30 outputs data of the terminal fitting 11 required for the wiring harness 2 toward the parts stock portion 14. The required non-colored parts 12,6,7,8,9 and terminal fitting 11 are conveyed toward the wiring harness assembling portion 15 from the parts stock portion 14. As above, at Step S2 the wiring harness assembling portion 15 secures the necessary non-colored electric wire 3 and non-colored parts 12,6,7,8,9, and Step S3*a* is reached.

At Step S3*a*, the coloring portion 45 colors the outer surface 3*a* of the covering portion of the non-colored electric wire 3 and conveys the electric wire 3 toward the sub-harness assembly line 26, and Step S3*b* is reached. At Step S3*b*, the coloring unit 32 of each sub-harness assembling portion 31 of the sub-harness assembly line 26 colors the outer surface 3*a* of the non-colored electric wire 3, and the second coloring unit 28 colors the non-colored parts 12,6,7,8,9. The cutting unit 33 cuts off the electric wire 3 having been colored by the coloring unit 32 in specified lengthes, removes the end portion of the covering portion, and attaches the terminal fitting 11 to the end portion. The joining unit 34 removes the covering portion of the connecting portion of the electric wire 3 and connects the electric wires 3 with the joint-terminal 5 if necessary. The sub-assembly unit 35 inserts the terminal fitting 11 attached to the end portion of the electric wire 3 into the connector housing 12. As above, the sub-harness 10 is assembled, and Step S4 is reached.

At Step S4, the sub-harness 10 is supplied to the wiring harness assembly line 27 from the sub-harness assembly line 26, and the colored parts 12,6,7,8,9 are also supplied from the second coloring unit 28 if necessary. At the wiring harness assembly line 27, a worker attaches the sub-harness 10 to the wiring board 36, and the parts 12,6,7,8,9 are attached to the sub-harness 10. The wiring harness assembly line 27 combines the sub-harnesses 10 thereby to assemble the wiring harness 2, and Step S5 is reached.

At Step S5, a conductivity test and an appearance inspection are carried out on the wiring harness 2 by the inspection unit 29, and Step S6 is reached. At Step S6, a non-defective wiring harness 2 is shipped to the wiring harness ordering side (motor vehicle manufacturer) 38.

According to the present embodiment, the non-colored electric wire 3 is secured by a required length after the receipt of order for the wiring harness 2, and the non-colored parts 12,6,7,8,9 are secured also after the receipt of order for the wiring harness 2. Therefore, the amount (length) of the electric wire 3 stocked beforehand and the amount of the parts 12,6,7,8,9 stocked beforehand can be reduced. The non-colored electric wire 3 is colored by the coloring portion 45 and the coloring unit 32, the non-colored parts 12,6,7,8,9 are colored by the second coloring unit 28, and then the wiring harness 2 is assembled. Therefore, the kind (color kind) of the electric wire 3 and the parts 12,6,7,8,9 to be stocked beforehand can be reduced.

The non-colored electric wire 3 is colored by both of the coloring portion 45 and each sub-harness assembling portion 31 of the sub-harness assembly line 26, the parts 12,6,7,8,9 are colored by the second coloring unit 28, the sub-harness 10 is assembled, and the sub-harnesses 10 are assembled into the wiring harness 2 at the wiring harness assembly line 27.

Therefore, the electric wire 3 is stocked only in the electric wire stock portion 13 and once stocked only between the coloring portion 45 and the sub-harness assembly line 26. The sub-harness 10 is once stocked only between the sub-harness assembly line 26 and the wiring harness assembly line 27. The non-colored parts 12,6,7,8,9 are directly supplied to the second coloring unit 28 from the parts stock portion 14. The colored parts 12,6,7,8,9 are directly supplied to the sub-harness assembling portion 31 or the wiring harness assembly line 27 from the second coloring unit 28. Therefore, the parts 12,6,7,8,9 only have to be stocked in the parts stock portion 14 and only have to be once stocked after the second coloring unit 28 and after the sub-harness assembling portion 31.

Therefore, the space for stocking the electric wire 3 and the parts 12,6,7,8,9 beforehand can be reduced. The space for once stocking the electric wire 3, the sub-harness 10, and the parts 12,6,7,8,9 during the manufacture can be reduced.

The color and the mark 39 on the electric wire 3 are not used for showing assembly steps but used for showing the kind of the electric wire, the conductor thickness, applied system, and the like.

The above-described embodiment is for the electric wire 3 forming the wiring harness 2 arranged on a motor vehicle. However, the wiring harness 2 manufactured by the inventive manufacturing method is not limited to a vehicle use and can be used for electronic equipment such as a portable computer and for various electric machines.

In the above-described embodiment, the sub-harness 10 has only the connector housing 12 as the parts. However, the sub-harness 10 may have at least one of the parts of the tube 6, the protector. 7, the grommet 8, and the tape 9.

In the present invention, various wire coloring means such as dipping, atomization, injection, printing, and transcription may be used. Further, the coloring liquid or the paint such as acrylic paint, ink (dye series and pigment series), and the like may be used. Further, in the above-described embodiment, the tube 6, the protector 7, the grommet 8, the tape 9, and the connector housing 12 are described as the parts. However, other parts like a rubber stopper forming the wiring harness 2 may be used.

INDUSTRIAL APPLICABILITY

As described above, according to the present invention, the non-colored electric wire is secured by a required length after the receipt of order for the wiring harness. Therefore, the amount (the length) of the electric to be stocked beforehand can be reduced. Further, the non-colored electric wire is used. Therefore, the kind (color kind) of the electric wire to be stocked beforehand can be reduced.

The sub-harness is assembled after, for example, coloring the outer surface of the non-colored electric wire, and the sub-harnesses are assembled into the wiring harness. Therefore, the sub-harness or the electric wire only has to be once stocked between the assembly of the sub-harnesses and the assembly of the wiring harness.

Therefore, the space for stocking the electric wire beforehand can be reduced, and the space for once stocking the electric wire and the sub-harness during the manufacture can be reduced.

According to the present invention, the non-colored parts are also secured after the receipt of order for the wiring harness. Therefore, the amount of the parts, in addition to the electric wire, to be stocked beforehand can be reduced. Further, the non-colored parts are used. Therefore, the kind (color kind) of the parts, in addition to that of the electric wire, to be stocked beforehand can be reduced.

The sub-harness is assembled after, for example, coloring the outer surfaces of the non-colored electric wire and non-colored parts, and the sub-harnesses are assembled into the wiring harness. Therefore, the sub-harness, the electric wire, or the parts only has to be once stocked between the assembly of the sub-harnesses and the assembly of the wiring harness and the coloring of the parts and the attaching of the parts to the sub-harness.

Therefore, the space for stocking the electric wire and the parts beforehand can be reduced, and the space for once stocking the electric wire, the parts, and the sub-harness during the manufacture can be reduced.

According to the present invention, the wiring harness assembling portion sends the wire amount data indicating the required amount of the electric wire to the electric wire stock portion after the receipt of order from the ordering side. The electric wire stock portion conveys the non-colored electric wire in accordance with the wire amount data toward the wiring harness assembling portion. Therefore, the amount (the length) of the electric wire to be once stocked at the wiring harness assembling portion can be reduced. Further, the non-colored electric wire is used. Therefore, the kind (color kind) of the electric wire to be stocked beforehand can be reduced.

The sub-harness is assembled by the sub-harness assembling portion after, for example, coloring the outer surface of the non-colored electric wire by the coloring unit, and the sub-harnesses are assembled into the wiring harness by the wiring harness assembling portion. Therefore, the sub-harness or the electric wire only has to be once stocked after the assembly of the sub-harness by the sub-harness assembling portion.

Therefore, the space for stocking the electric wire beforehand can be reduced, and the space for once stocking the electric wire and the sub-harness during the manufacture can be reduced.

According to the present invention, the wiring harness assembling portion sends the parts amount data indicating the required amount of the parts, in addition to the wire amount data, to the parts stock portion after the receipt of order from the ordering side. The parts stock portion conveys the non-colored parts in accordance with the parts amount data toward the wiring harness assembling portion. Therefore, the amount of the parts, in addition to the amount of the electric wire, to be once stocked at the wiring harness assembling portion can be reduced. Further, the non-colored parts are used. Therefore, the kind (color kind) of the parts to be stocked beforehand can be reduced.

The sub-harness is assembled by the sub-harness assembling portion after, for example, coloring the outer surfaces of the non-colored parts by the second coloring unit, and the sub-harnesses are assembled into the wiring harness by the wiring harness assembling portion. Therefore, the sub-harness, the electric wire, or the parts only has to be once stocked after the assembly of the sub-harness by the sub-harness assembling portion.

Therefore, the space for stocking the electric wire and the parts beforehand can be reduced, and the space for once stocking the electric wire, the parts, and the sub-harness during the manufacture can be reduced.

According to the present invention, the non-colored electric wire is secured by a required length after the receipt of order for the wiring harness. Therefore, the amount (the length) of the electric to be stocked beforehand can be reduced. Further, the outer surface of the non-colored electric wire is colored after the receipt of order for the wiring harness. Therefore, the kind (color kind) of the electric wire to be stocked beforehand can be reduced.

The sub-harness is assembled after, for example, further coloring the outer surface of the non-colored electric wire, and the sub-harnesses are assembled into the wiring harness. Therefore, the sub-harness or the electric wire only has to be once stocked between the assembly of the sub-harnesses and the assembly of the wiring harness.

Therefore, the space for stocking the electric wire beforehand can be reduced, and the space for once stocking the electric wire and the sub-harness during the manufacture can be reduced.

According to the present invention, the non-colored parts are further secured after the receipt of order for the wiring harness. Therefore, the amount of the parts, in addition to the electric wire, to be stocked beforehand can be reduced. Further, the parts are colored after the receipt of order for the wiring harness. Therefore, the kind (color kind) of the parts, in addition to that of the electric wire, to be stocked beforehand can be reduced.

Therefore, the space for stocking the electric wire and the parts beforehand can be reduced, and the space for once stocking the electric wire, the parts, and the sub-harness during the manufacture can be reduced.

According to the present invention, the wiring harness assembling portion sends the wire amount data indicating the required amount of the electric wire to the electric wire stock portion after the receipt of order from the ordering side. The electric wire stock portion conveys the non-colored electric wire in accordance with the wire amount data toward the coloring portion. The coloring portion colors the non-colored electric wire and conveys the colored electric wire toward the wiring harness assembling portion. Therefore, the amount (the length) of the electric wire to be once stocked at the wiring harness assembling portion can be reduced. Further, the outer surfaces of the non-colored electric wire are colored after the receipt of order for the wiring harness. Therefore, the kind (color kind) of the electric wire to be stocked beforehand can be reduced.

The sub-harness is assembled by the sub-harness assembling portion after, for example, further coloring the outer surface of the electric wire by the coloring unit, and the sub-harnesses are assembled into the wiring harness by the wiring harness assembling portion. Therefore, the sub-harness or the electric wire only has to be once stocked after the assembly of the sub-harness by the sub-harness assembling portion.

Therefore, the space for stocking the electric wire beforehand can be reduced, and the space for once stocking the electric wire and the sub-harness during the manufacture can be reduced.

According to the present invention, the wiring harness assembling portion sends the parts amount data indicating the required amount of the parts, in addition to the wire amount data, to the parts stock portion after the receipt of order from the ordering side. The parts stock portion conveys the non-colored parts in accordance with the parts amount data toward the wiring harness assembling portion. Therefore, the amount of the parts, in addition to the amount of the electric wire, to be once stocked at the wiring harness assembling portion can be reduced. Further, the outer surfaces of the parts are colored after the receipt of order for the wiring harness. Therefore, the kind (color kind) of the parts to be stocked before hand can be reduced.

The sub-harness is assembled by the sub-harness assembling portion after, for example, coloring the outer surfaces of the non-colored parts by the second coloring unit, and the sub-harnesses are assembled into the wiring harness by the wiring harness assembling portion. Therefore, the sub-harness, the electric wire, or the parts only has to be once stocked after the assembly of the sub-harness by the sub-harness assembling portion.

Therefore, the space for stocking the electric wire and the parts beforehand can be reduced, and the space for once stocking the electric wire, the parts, and the sub-harness during the manufacture can be reduced.

The invention claimed is:

1. A wiring harness job-order production method wherein sub-harnesses each having electric wires and terminal fittings attached to the electric wires are assembled and a wiring harness is manufactured by putting the sub-harnesses together, characterized in that the method comprises the steps of:

securing a non-colored electric wire having at least a necessary length required for the wiring harness after a receipt of an order for a wiring harness, coloring an outer surface of the non-colored electric wire, cutting the resultant colored electric wire in a specified length, attaching the terminal fittings to the resultant colored electric wires thereby to obtain the sub-harnesses, and putting the sub-harnesses together.

2. The wiring harness job-order production method as set forth in claim 1, characterized in that the sub-harness has parts attached to either the resultant colored electric wires or the terminal fittings, and required non-colored parts are secured after a receipt of the order for the wiring harness, outer surfaces of the non-colored parts are colored, the colored parts are attached to the resultant colored electric wires or the terminal fittings thereby to assemble the sub-harness.

3. A wiring harness job-order production method wherein sub-harnesses each having electric wires and terminal fittings attached to the electric wires are assembled and a wiring harness is manufactured by putting the sub-harnesses together, characterized in that the method comprises the steps of:

securing a non-colored electric wire having at least a necessary length required for the wiring harness after a receipt of an order for a wiring harness, coloring an outer surface of non-colored electric wire, further coloring the outer surface, cutting the resultant colored electric wire in a specified length, attaching the terminal fittings to the resultant colored electric wires thereby to obtain the sub-harnesses, and putting the sub-harnesses together.

4. The wiring harness job-order production method as set forth in claim 3, characterized in that the sub-harness has parts attached to either the resultant colored electric wires or the terminal fittings, and required non-colored parts are secured after a receipt of the order for the wiring harness, outer surfaces of the non-colored parts are colored, the colored parts are attached to the resultant colored electric wires or the terminal fittings thereby to assemble the sub-harness.

* * * * *